United States Patent [19]

Williams

[11] Patent Number: 4,579,304

[45] Date of Patent: Apr. 1, 1986

[54] TUBE BUNDLE SUPPORT

[76] Inventor: George J. Williams, 36 Hickory La., Chalfont, Pa. 18914

[21] Appl. No.: 500,022

[22] Filed: Jun. 1, 1983

[51] Int. Cl.[4] ..... F16L 3/22

[52] U.S. Cl. ..... 248/68.1; 165/172

[58] Field of Search ..... 248/68.1, 68.2; 165/162, 172

[56] References Cited

U.S. PATENT DOCUMENTS

| | | | |
|---|---|---|---|
| 1,852,363 | 4/1932 | Parent | 248/68.1 |
| 1,882,474 | 10/1932 | Black | 165/162 |
| 2,980,404 | 4/1961 | Andersen et al. | 248/68.1 |
| 3,437,297 | 4/1969 | Jirka et al. | 248/68.2 |
| 3,820,594 | 6/1974 | Ritland et al. | 165/162 |
| 3,996,102 | 12/1976 | Thome | 165/162 |
| 4,099,626 | 7/1978 | Magnussen | 248/68.1 |
| 4,143,709 | 3/1979 | Cunningham | 248/68.1 |
| 4,202,520 | 5/1980 | Loos et al. | 248/68.1 |
| 4,210,202 | 7/1980 | Boyer et al. | 248/68.1 |
| 4,276,930 | 7/1981 | Weber | 165/162 |
| 4,359,088 | 11/1982 | Jabsen | 165/172 |
| 4,384,697 | 5/1983 | Ruhe | 248/68.1 |

FOREIGN PATENT DOCUMENTS

| | | | |
|---|---|---|---|
| 1223045 | 2/1971 | United Kingdom | 248/68.1 |

*Primary Examiner*—Ramon S. Britts
*Assistant Examiner*—Ramon O. Ramirez
*Attorney, Agent, or Firm*—Joseph W. Molasky & Assocs.

[57] ABSTRACT

A supporting means for a tube bundle arranged in an array having a plurality of rows of parallel tubes is constructed of a plurality of first and second strip members extending transversely to one another and being interlocked at cooperating slots to form a lattice structure of crossed strips with openings for receiving the tubes, and a frame extending around the periphery of the tube bundle array in engagement with the ends of the strip members.

3 Claims, 4 Drawing Figures

TUBE BUNDLE SUPPORT

BACKGROUND AND SUMMARY OF THE INVENTION

This invention relates to supporting means for tube bundles of the type employed in surface condensers, heat exchangers and similar equipment.

In the use of tube bundles of the indicated type support plates are provided at longitudinally spaced intervals to provide support for the array of tubes forming the tube bundle. The support plates in use today comprise metal plates provided with a plurality of drilled holes of a size and location to receive the tubing required to achieve the necessary heat exchange action desired of the tube bundle. Since these support plates are an integral part of the supporting structure, they are designed to satisfy the mechanical loading requirements of the structure. The result of this type of design was material thicknesses of the plates ranging from $\frac{1}{4}$ inch to $\frac{3}{4}$ inch depending upon the size and/or service requirements. While this thickness range satisfied the structural requirements, it had, until recently, provided less than adequate support for the tubing. In the mid-1970's the standards for fabrication of condensers, heat exchangers and the like were changed to reduce the recommended spacing between the support plates to thereby improve the tube support. However, the drilled type of support plate is not entirely satisfactory and has many disadvantages. For example, it is expensive to manufacture, cumbersome to handle and it is difficlut to assemble the tubes therein.

It is the general object of the invention to provide a supporting means for tube bundles or the like which is inexpensive and easy to manufacture, permits the easy assembly of the tubes therein, and provides better support for the tubes than the prior art drilled support plate design.

Briefly stated, the supporting means in accordance with the invention comprises a plurality of first and second strip members extending transversely to one another and being interlocked at cooperating slots formed therein to form a lattice structure of crossed strips with openings therebetween for receiving the tubes. A frame means extends around the perimeter of the lattice structure for providing additional support and for mounting the tube support in the equipment.

The supporting means of the invention comprising the lattice structure has several important advantages over the prior art drilled hole type of support plate.

Firstly, the supporting means in accordance with the invention provides a better support for the tubes since the strips are wider than the drilled hole type of support plate. For example, the strips of the supporting means in accordance with the invention can be made of a $1\frac{1}{2}$ inch width which is simply impractical to have with a drilled support plate. A support plate of a comparable width to the support means of the invention would be too expensive and difficult to manufacture and too heavy and cumbersome to handle.

Also, the supporting means of the invention provides better alignment of the openings through which the tubes are to be pushed since the parts are assembled on a fixture and not the result of the multi-spindle drilling techniques used to manufacture the drilled hole type of support plate. Multiple spindle drilling simply cannot produce consistently accurate hole spacing and location. On the other hand, the lattice structure in accordance with the invention does provide very accurate spacing and location of the openings for the tubes.

Further, the supporting means in accordance with the invention can be constructed to provide surfaces onto which the tubes are pushed that are considerably smoother than those that can be achieved with the drilled hole type of support plates. In the support means of the invention, the crossed strips can be made from the same material as the tubes and, therefore, have the same degree of surface finish or smoothness. With the drilled hole support plate, it is necessary to make the support plates of a high strength material such as carbon steel which cannot achieve the same smoothness without very special manufacturing techniques which are very expensive.

Also, the strips used in the supporting means of the invention can be made of corrosion resistent material such as stainless steel and, as a result, can resist corrosion during storage better than the drilled hole support plate. The drilled hole support plate cannot be made of a corrosion resistent material such as stainless steel because of the high cost. With the tube support of the invention, the crossed strips that contact the tubes can be made of stainless steel while the frame therefor, which does not contact the tubes, can be made of a high strength material such as carbon steel.

Another feature of the supporting means in accordance with the invention is that it is possible to provide more heat transfer surface for the same amount of tube-displaced area. In the support means of the invention, special laning is not necessary to get the liquid to be cooled into the center of the bundle since in the lattice design there are provided spaces around the tubes. This allows for longitudinal flow of the liquid being cooled through the tube support. The drilled hole support plate has no space between the tubes and the hole through which the tube extends, and, therefore, it is necessary to eliminate some of the tubes in the bundle to provide lanes for the flow of the water being cooled. Accordingly, the design of the invention allows for the provision of more tubes in the bundle.

The use of metal strips to support the tubes in a tube bundle is known as is described in my copending application Ser. No. 499,831, filed June 1, 1983 and U.S. Pat. No. 4,210,202.

DETAILED DESCRIPTION OF THE PREFERRED EMBODIMENT

Figure 1:
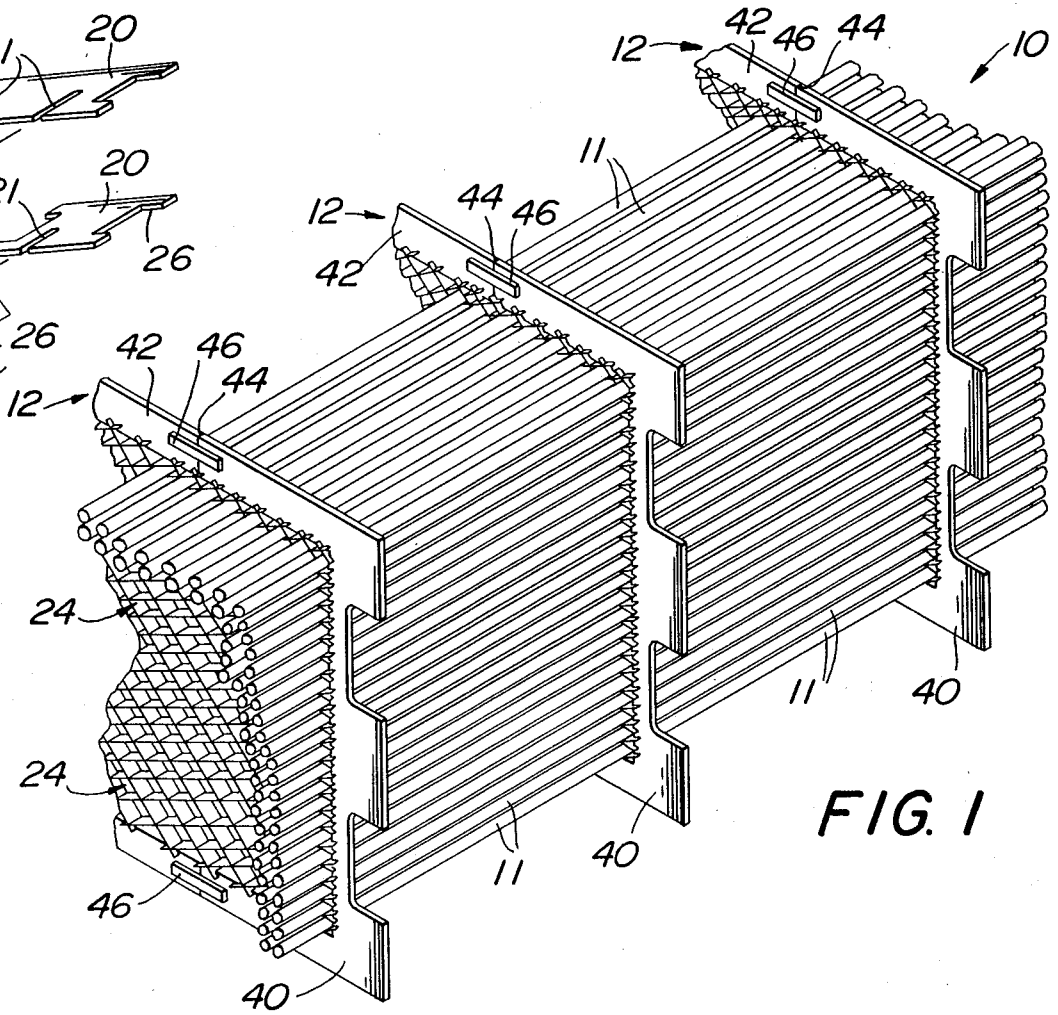
FIG. 1 is a perspective view showing a tube bundle having a supporting means in accordance with the invention.
Figure 2:
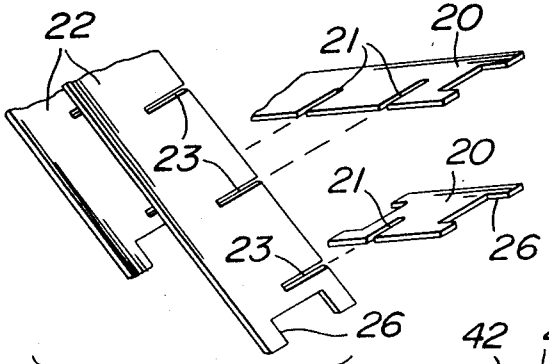
FIG. 2 is a fragmentary view showing the manner in which the lattice structure is assembled.

In FIG. 1 there is shown a typical tube bundle 10 of the type which would be used in a steam surface condenser, a heat exchanger or similar equipment. Tube bundle 10 comprises a plurality of rows of parallel tubes 11 supported at longitudinally spaced apart locations by support means 12 in accordance with the invention. Each support means 12 is comprised of a lattice structure made of interlocking flat strips, preferably of stainless steel, and a frame extending around the perimeter of the lattice structure and made of a high strength material such as carbon steel.

The lattice structure comprises a plurality of first strip members 20 for providing supporting contact with individual tubes 11 of tube bundle 10 and a plurality of second strip members 22 constructed and arranged to extend transversely to first strip members 20 to provide supporting contact for tubes 11 as is shown in the drawings. Strip members 20 and 22 are interlocked at cooperating slots 21 and 23, respectively, formed therein to form a lattice structure of crossed strips with parallelogram-shaped openings 24 therebetween for receiving tubes 11 of tube bundle 10. The assembly is like the well known "egg crate" structure.

Figure 3:
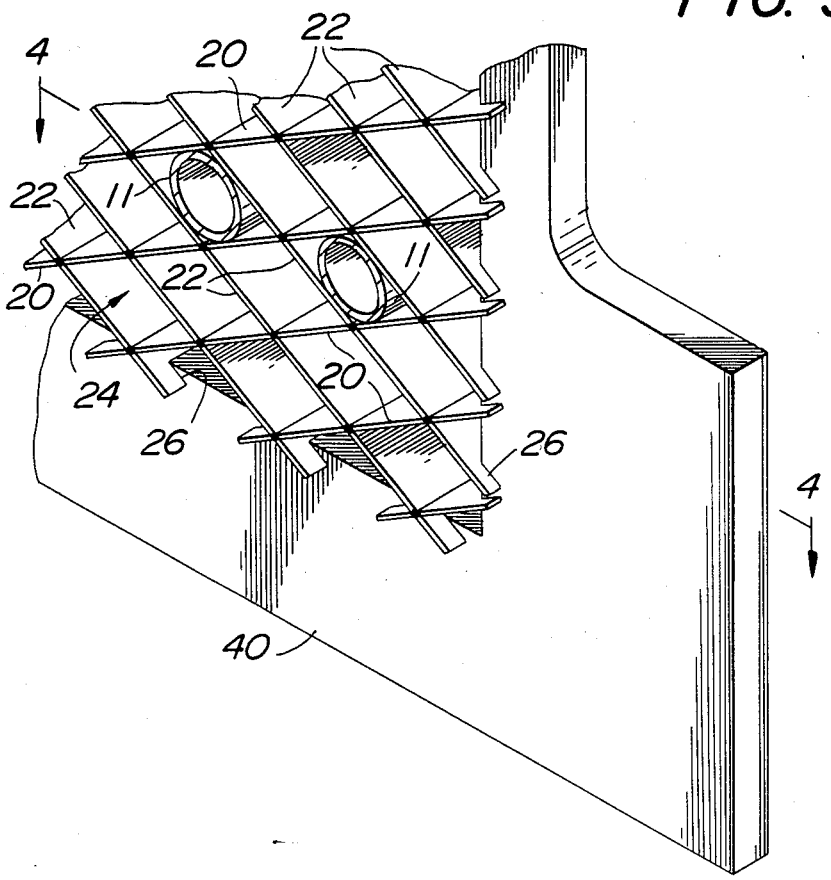
FIG. 3 is a fragmentary view of a portion of the supporting means in accordance with the invention.
Figure 4:
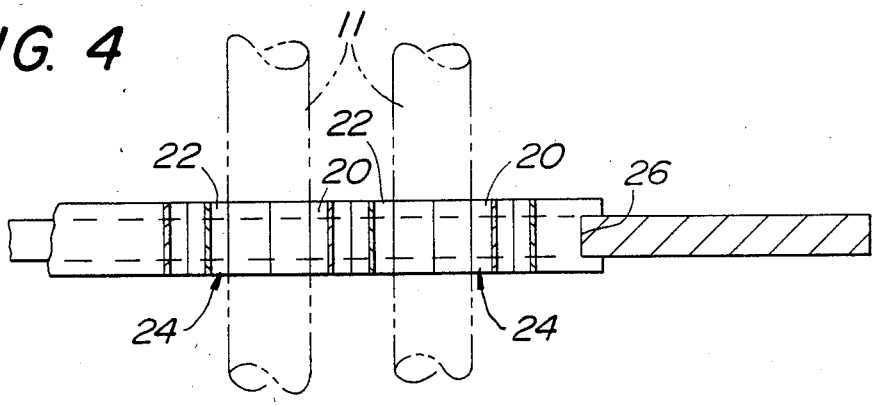
FIG. 4 is a sectional view taken on line 4—4 of FIG. 3.

Means are provided for securing strip members 20 and 22 together to provide a free standing lattice structure. To this end, strip members 20 and 22 are joined together at their intersections by welding when they are made of metal as shown in FIG. 3. It will be apparent that if the strips 20 and 22 are made of a non-metallic material, suitable adhesives for cements can be used to join the crossed strips at their intersections.

Each support means 12 comprises a frame made of two frame-shaped half plates 40 and 42 extending around the periphery of the array of tube bundle 10 in engagement with the ends of strip members 20 and 22. Each of the half plates 40 and 42 has a pair of horizontal legs and a vertical leg. Strip members 20 and 22 are provided with recesses or notches 26 in the ends thereof adapted to receive plates 40 and 42 forming the frame. The half plates 40 and 42 frame are joined at their horizontal legs at intersections 44 whereat they are welded together and provided with additional stiffening plates 46 on both sides thereof for securing half plates 40 and 42 together, as is best shown in FIG. 1. By this arrangement, the support means 12 is assembled by sliding the half plates 40 and 42 together horizontally into the notches in the ends of a lattice structure of strip members 20 and 22 until they meet at intersections 44.

The support means 12 of the invention can have the tubes 11 of the tube bundle 10 inserted therein easily because of the accurate alignment of the parallelogram-shaped openings 24 between the strip members 20 and 22 and the relatively smooth frictional contact between the tubes 11 and the strip members 20 and 22 during the tube inserting procedure. Moreover, the wide strip members 20 and 22 provide a very strong support for the tubes 11 and there is no need to provide special laning for the flow of the liquid to be cooled into the center of the tube bundle 10 during use as a heat exchanger, condenser or the like.

What is claimed is:

1. Supporting means for tube bundles or the like arranged in an array having a plurality of rows of parallel tubes comprising:

a plurality of first strip members, a plurality of second strip members extending transversely to said first strip members, said first and second strip members being interlocked at cooperating slots formed therein to form a lattice structure of crossed strips with openings therebetween for receiving the tubes, including recesses on the ends of said strip members for receiving the frame means; and frame means in engagement with the ends of said first and second strip members said frame means consisting essentially of two frame-shaped half plates each having a pair of horizontal legs and a vertical leg, said horizontal legs being joined together to afford a frame which extends around the periphery of said tube bundle.

2. Supporting means according to claim 1 wherein said first and second strips are joined together at the intersection thereof where said first and second strip members cross.

3. Supporting means according to claim 2 wherein said frame means extends around the periphery of the array of the tube bundles in engagement with the ends of said strip members.

* * * * *